US006945785B2

(12) United States Patent
Sohl et al.

(10) Patent No.: US 6,945,785 B2
(45) Date of Patent: Sep. 20, 2005

(54) DRY ERASE BOARD WITH IMAGE IN RELIEF

(76) Inventors: Henry Ellis Sohl, 12204 E. Osage Rd., Louisville, KY (US) 40223; Lawrence Woodcock Gorin, 2001 Long Knife Ct., Louisville, KY (US) 40207

( * ) Notice: Subject to any disclaimer, the term of this patent is extended or adjusted under 35 U.S.C. 154(b) by 0 days.

(21) Appl. No.: 10/845,803

(22) Filed: May 14, 2004

(65) Prior Publication Data

US 2004/0229202 A1 Nov. 18, 2004

Related U.S. Application Data

(60) Provisional application No. 60/470,587, filed on May 15, 2003.

(51) Int. Cl.[7] ..... B43L 1/00
(52) U.S. Cl. ..... 434/408
(58) Field of Search ..... 434/152, 408, 434/413, 416, 425, 428, 430, 81

(56) References Cited

U.S. PATENT DOCUMENTS

| | | | | |
|---|---|---|---|---|
| 861,822 A | | 7/1907 | Feher | |
| 2,183,426 A | | 12/1939 | Hart | |
| 2,538,085 A | | 1/1951 | Cotton | |
| 2,631,046 A | | 3/1953 | Stephens | |
| 2,643,899 A | | 6/1953 | Cavalero | |
| 2,889,651 A | | 6/1959 | Baldanza | |
| 2,946,137 A | | 7/1960 | Worth et al. | |
| 3,057,097 A | | 10/1962 | Douglas | |
| 3,310,321 A | | 3/1967 | Freund | |
| 3,321,860 A | | 5/1967 | Dichtl et al. | |
| RE26,948 E | | 9/1970 | Klein | |
| 3,634,951 A | * | 1/1972 | Knoll | 434/152 |
| 3,758,358 A | | 9/1973 | Kuroda | |
| 3,798,806 A | | 3/1974 | Sanford | |
| 3,972,417 A | | 8/1976 | Iten et al. | |
| 4,109,399 A | | 8/1978 | Ivancevich | |
| 4,148,580 A | * | 4/1979 | Hill, Sr. | 355/52 |
| 4,161,090 A | | 7/1979 | Watts, Jr. | |
| 4,215,499 A | | 8/1980 | Wilson | |
| 4,344,997 A | | 8/1982 | Paquette | |
| 4,380,128 A | | 4/1983 | Ichikawa | |
| 4,477,243 A | | 10/1984 | Wallsten | |
| 4,555,423 A | | 11/1985 | Sands | |
| 4,579,708 A | | 4/1986 | Rosart | |
| 4,737,329 A | | 4/1988 | Rakoczy | |
| 4,779,734 A | | 10/1988 | Kydonieus | |
| 4,828,502 A | * | 5/1989 | Leahy | 434/416 |
| 4,840,275 A | | 6/1989 | Faiola et al. | |
| 4,841,651 A | | 6/1989 | Conner | |
| 4,848,015 A | | 7/1989 | Allen | |
| 4,883,692 A | | 11/1989 | Spector | |
| 4,951,404 A | | 8/1990 | Lithwick | |
| 4,979,619 A | | 12/1990 | Hager | |
| 5,001,853 A | | 3/1991 | Odien | |
| 5,035,626 A | * | 7/1991 | Persing | 434/408 |
| 5,119,574 A | | 6/1992 | King | |
| 5,181,745 A | | 1/1993 | Jacobsen et al. | |
| 5,199,745 A | | 4/1993 | Balsamo | |
| 5,201,548 A | | 4/1993 | Lang et al. | |
| 5,217,162 A | | 6/1993 | Shibahara | |
| 5,345,705 A | | 9/1994 | Lawrence | |
| 5,377,836 A | | 1/1995 | Eisenbraun | |
| 5,379,886 A | | 1/1995 | Brauner et al. | |
| 5,600,939 A | | 2/1997 | Giovannone | |

(Continued)

FOREIGN PATENT DOCUMENTS

| | | |
|---|---|---|
| CH | 19847 | 4/1900 |

*Primary Examiner*—Kurt Fernstrom
(74) *Attorney, Agent, or Firm*—Camoriano and Associates; Theresa Fritz Camoriano

(57) ABSTRACT

A dry erase board is provided with a relief image. There may be a reinforcement behind the relief image to prevent it from distorting during use. The board may include a frame and means for securing a dry erase marker to the board.

19 Claims, 3 Drawing Sheets

U.S. PATENT DOCUMENTS 5,626,478 A * 5/1997 Gatlin ..... 434/247
5,658,635 A * 8/1997 Davis et al. ..... 428/81
5,721,041 A 2/1998 Baratto
5,743,414 A * 4/1998 Baudino ..... 211/69.1
5,846,084 A * 12/1998 Volpe Prignano ..... 434/151
5,879,028 A 3/1999 Benoit
5,960,527 A 10/1999 Ellison et al.
6,007,891 A 12/1999 Davis et al.
6,066,391 A 5/2000 Ogawa et al.
6,106,023 A 8/2000 Sud et al.
6,117,384 A 9/2000 Laurin et al.
6,325,501 B2 12/2001 Kuwabara et al.
6,410,416 B1 6/2002 Dodabalapur et al.
6,444,147 B1 9/2002 Harding
6,444,148 B2 9/2002 Harding
6,648,051 B1 * 11/2003 Young ..... 160/199
6,736,644 B1 * 5/2004 Vaughn ..... 434/408
D496,068 S * 9/2004 Mandel ..... D19/36
6,837,715 B2 * 1/2005 Beno ..... 434/408
6,866,516 B2 * 3/2005 Smith et al. ..... 434/408
2002/0009703 A1 1/2002 Owen
2003/0077562 A1 4/2003 Donelan

* cited by examiner

DRY ERASE BOARD WITH IMAGE IN RELIEF

BACKGROUND

This application claims priority from U.S. patent application Ser. No. 60/470,587, filed May 15, 2003.

The present invention relates to dry erase boards, which are also known as write on—wipe off boards, and, in particular, to a dry erase board including an image in relief.

Dry erase boards are well known in the art. They are found in classrooms (replacing chalkboards) and in board rooms (often replacing flip charts). Smaller dry erase boards are used on doors, walls, and lockers, in homes, dormitories, restaurants, and various other places where people want to jot down notes. The user writes on the dry erase board with a dry erase marker and then simply wipes off the marking using a cloth or dry eraser.

Some dry erase boards include colorful images, which make them more eye-catching than the typical white board. There has been a desire to further enhance the boards to provide an image in relief on the boards, to make them more eye-catching or appealing, but so far there has been no effective, practical way to achieve that goal. Some people provide a separate frame with a raised image that surrounds the dry erase board, but nobody has made a dry erase board that includes an image in relief on the dry erase writing surface itself.

The type of material that will accept an image typically is not the type of material that can also repel the ink from a dry erase marker so that it can easily be wiped off without requiring the use of solvent. For the few products that have managed to provide both a dry erase surface and an image, the materials and construction methods that are used do not permit thermoforming to put the image in relief. When the current inventors began trying to produce such a produce, they were told that it could not be done—that there would be problems with delamination, with bubbles between the laminate and substrate, and so forth.

SUMMARY

The present invention provides a dry erase board with an image in relief on the board itself. A manufacturing method is taught in which a plastic sheet receives the image and is then thermoformed to put the image in relief. The product includes a surface finish that permits it to be used with dry erase markers. The resulting product is attractive, sturdy, and weather resistant and can be used indoors or outdoors.

DESCRIPTION OF THE PREFERRED EMBODIMENTS

Figure 1:
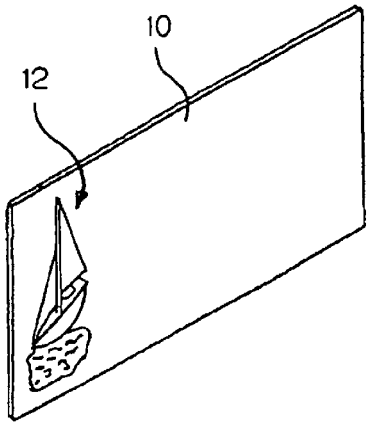
FIG. 1 is a schematic perspective view of a flat sheet of material onto which an image has been applied.
Figure 2:
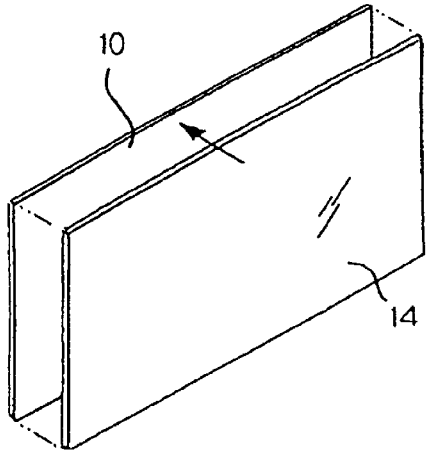
FIG. 2 is a schematic perspective view showing a coating of laminating material being applied to the front of the flat sheet of FIG. 1.

FIG. 1 shows a flat sheet of material 10 onto which an image 12 has been applied. In this particular embodiment, the material 10 is a relatively thin sheet of styrene or other moldable plastic material, preferably between 0.07 gauge and 0.30 gauge thick, and the image 12 is a full color image that has been printed onto the sheet 10 by running the sheet through a color printer. However, the sheet 10 could be made of various other materials, and the image 12 could be applied in various other ways, including silk screening, drawing, applying the image to a separate sheet that is laminated onto the sheet 10, and so forth.

While this drawing indicates that a single image 12 is being applied to a single small sheet 10, it is also intended that this product could be mass produced, with the sheet 10 being on a roll or stacked as flat sheets, and the images 12 being printed continuously onto the roll or sheets as they pass by. It is preferable that the final product have a front surface area of at least ⅛ sq. ft. in order to provide a sufficient surface area to function as a dry erase board, and it may be much larger, for example covering the entire wall of a classroom.

Once the image 12 has been applied to the front surface of the sheet 10, a laminating sheet 14 is applied onto the front surface of the sheet 10 carrying the image 12. The laminating sheet 14 preferably is transparent, although it could alternatively be translucent, to add a visual effect to the image 12. In any case, the image 12 is visible through the laminating sheet 14 once the laminating sheet 14 has been applied. The laminating sheet 14 is made of a material that is compatible with dry erase markers, meaning that the dry erase marker can be used on the sheet 14 and will readily wipe off with just a dry cloth, without requiring the use of solvents. While applying a coating by means of lamination is preferred, it is also understood that a dry-erase-compatible coating could be applied by other means, such as by spraying onto the surface.

In this preferred embodiment, the laminating sheet 14 is a 2 mil vinyl film, and it is applied using hydraulic pressure and heat, but other types of coatings 14 and other means of securing the coating 14 to the sheet 10 could be used. The laminating process used in this preferred embodiment (although not necessarily the same materials) has been used to make credit cards, with laminating sheets being applied both to the front and back surfaces of the credit card, giving it a hard, protective outer surface. A coating could also be applied to the back of the sheet 10, if desired, but it is not necessary, as only the front of the dry erase board requires the dry erase properties.

Figure 3:
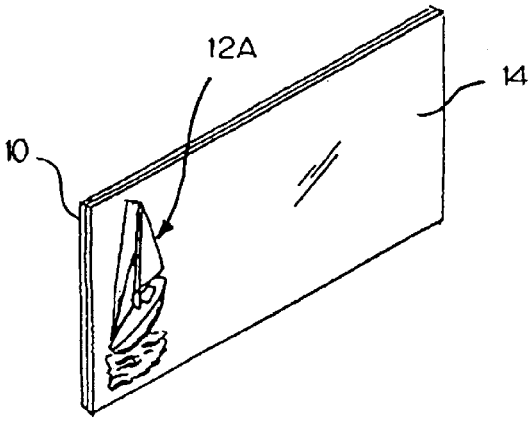
FIG. 3 is a schematic perspective view showing the coated sheet of FIG. 2 after it has been formed, with details of the image being in relief, departing from the normal flat surface of the sheet.

Then, as shown in FIG. 3, once the laminating sheet 14 has been applied to the backing sheet 10, the product is thermo-formed, such as by vacuum forming, to create relief (raised and lowered surface portions) in registration with the image. The relief image 12A is the same as the image 12 of FIG. 1, but now it has varying surface height and depth. For example, in this particular image, the sails on the boat are in abrupt relief from the background, projecting as much as one inch forward of the normal flat surface, and the water may be both below the normal flat surface and above that surface, at varying depths, for example, from ¼" below the normal flat surface to ¼" above the normal flat surface, in registration with the image. In this preferred embodiment, the continuous relief or varying of surface depth is achieved by vacuum forming. However, other methods of creating relief may be used instead. It is preferred that the relief or draw be at least 3/16" from the lowest depth to the highest, more preferable that the relief be at least ¼", and the actual draw or depth may be 1.5 inches, and possibly even greater, depending upon the materials, the image, and the desired artistic look of the piece.

In many cases, in order to produce an attractive relief image, it is desirable to provide intricate detail both in the image 12 and in the relief image 12A, so that the variations in surface depth of the relief image 12A coincide with intricate details in the image 12. For example, in this particular relief image 12A, it might be desirable to show a change in surface depth to correspond with the grain in the wood from which the boat's hull is made, or to show changes in depth for tiny ripples in the water. It is difficult to achieve such fine detail in a very thick material. It also may be difficult or impractical to apply images onto a very thick material that will not pass through a printing press, for example. Therefore, there are many functional reasons, as well as cost reasons, why it may be desirable for the material 10 to be a relatively thin sheet. If that is the case, then it also may be desirable to provide some type of reinforced backing to the product to prevent the relief image from distorting during use.

Figure 4:
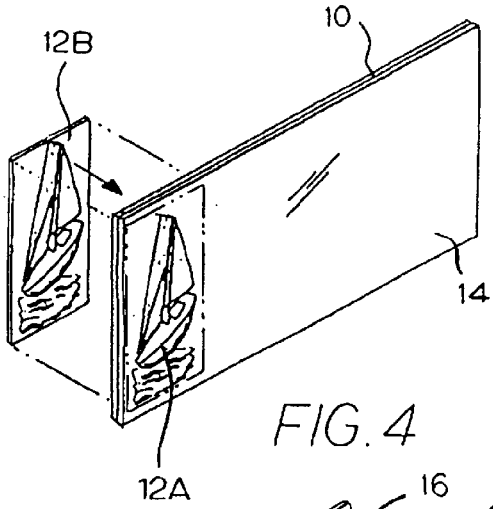
FIG. 4 is a schematic perspective view showing a reinforcement, having the same relief contour as the relief image of FIG. 3, being applied to the back of the formed, coated sheet of FIG. 3.

FIG. 4 shows a reinforcement 12B being applied to the back surface of the sheet 10 behind the relief image 12A. In this preferred embodiment, the reinforcement 12B is made of a sheet of plastic material that has been formed to the same contour or very close to the same contour as the sheet 10. This reinforcing sheet 12B preferably is made of a heavier gauge of material than the sheet 10, although even a thinner gauge of material may provide sufficient reinforcement. If the sheet 10 is made of thin enough material that the reinforcement 12B might be visible or show through, it may be desirable to make the reinforcement 12B of a clear material, such as PETG or PVC or other material, or to make the reinforcement 12B of a material that will be neutral or that will not detract from the relief image 12A.

The reinforcement 12B may be adhered to the back of the sheet 10 over portions of its front surface or over its entire front surface, or it may be secured by other means, such as by being sandwiched between the sheet 10 and a backing sheet or board (not shown) to hold it in place. The reinforcement 12B may be made of a formed sheet material, as shown here, or it may take other forms. For example, U.S. Pat. No. 6,651,370 shows a reinforced backing that includes ribs, and that type of reinforcement may be used here. Also, U.S. Pat. No. 6,625,914 shows a filler being poured onto the back of the sheet carrying the raised image and hardening to form a more solid reinforcement, and that type of reinforcement could be used here as well. The closer the front surface of the reinforcement conforms to the shape of the relief image 12A, the better support it will provide. In this preferred embodiment 12B, the same die that is used to form the relief image 12A is used to form the reinforcement 12B, so the reinforcement 12B conforms very closely to the shape and contours of the relief image 12A. In this embodiment, the reinforcement 12B is only in the area of the relief image, but it could be behind the entire sheet 10.

As shown in these drawings, it is also desirable for a substantial portion of the sheet 10 to remain flat, to provide a convenient writing surface. Preferably, at least three-fourths of the surface area of the sheet 10 will remain flat. While this particular embodiment shows the relief image 12B being on one side, it could be located anywhere on the sheet 10, depending upon the image 12A and the intended use of the dry erase board. For example, if it is to be used as a sports scoreboard, it may be desirable for the relief image 12A to be an image of the home team's mascot in the center of the board, with flat surface area on either side, onto which the scores of the two teams could be written as the game goes along.

Figure 5:
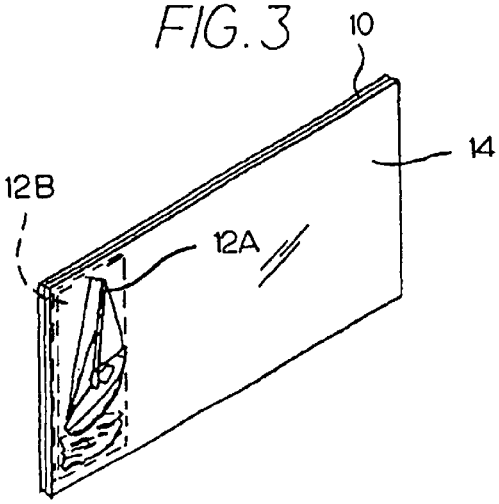
FIG. 5 shows the product of FIG. 4 with the reinforcement having been applied.

FIG. 5 shows the product with the reinforcement 12B having been applied to the back of the sheet 10 in the area of the relief image 12A. It is generally not necessary to reinforce the flat portion of the sheet 10, although such reinforcement could be provided if desired.

Figure 6:
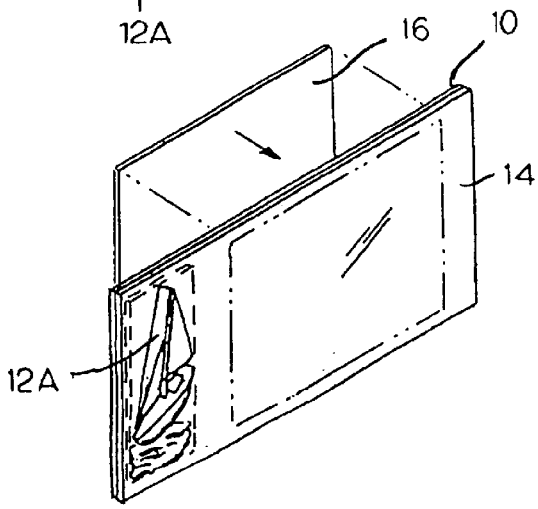
FIG. 6 is a schematic perspective view showing a sheet of metal-containing material being applied to the back of a flat section of the product of FIG. 5.
Figure 7:
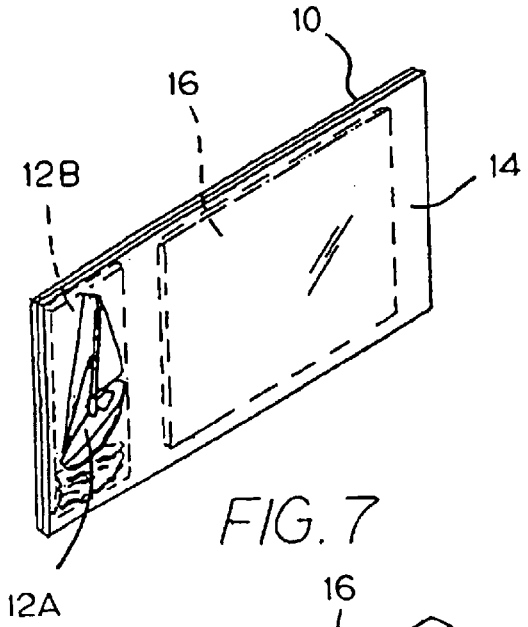
FIG. 7 shows the product of FIG. 6 after the sheet of metal-containing material has been added.

FIGS. 6 and 7 show a sheet 16 of metal-containing material being added to the back of the flat portion of the sheet 10. This sheet 16 may be added if it is desired to be able to attach magnets to the dry erase board. Again, this metal-containing sheet 16 may be adhered to the back of the sheet 10, or it may be secured by other means, such as riveting, clamping, and so forth. The purpose of this sheet 16 is to provide a place where a magnet can stick to the product, so notes can not only be jotted down on the flat surface with a dry erase marker, but pieces of paper such as photos or shopping lists and the like may be secured to the front of the board with a magnet that is attracted to the metal-containing material of the sheet 16. It is also possible to add a cork board, foam, or other similar area to the front or edge of the board (not shown) in order to permit the board to accept pins for pinning messages to the front as in a normal bulletin board.

Figure 8:
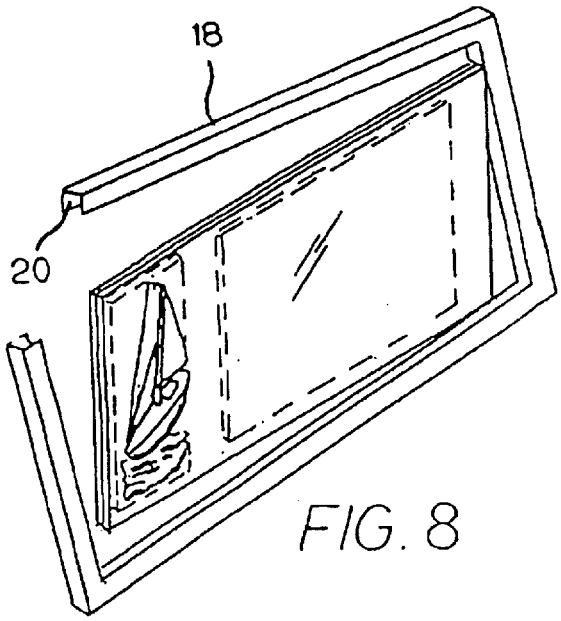
FIG. 8 shows a frame being applied to the product of FIG. 7.
Figure 9:
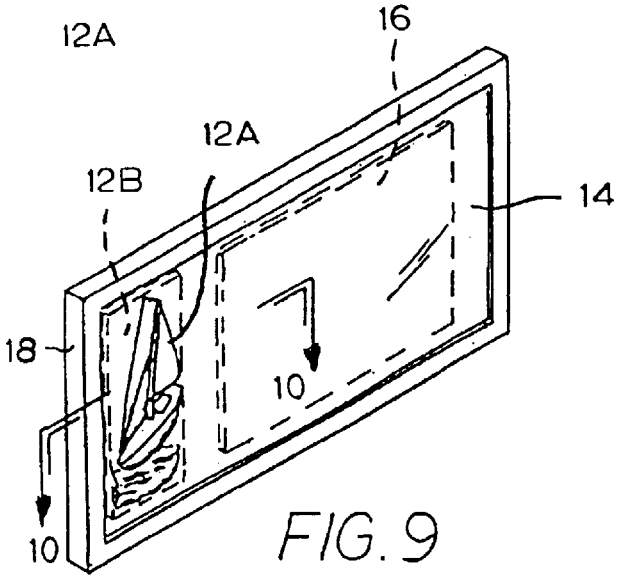
FIG. 9 shows the product of FIG. 8 with the frame having been applied.

FIGS. 8 and 9 show an optional frame 18 being added to the perimeter of the product. The frame 18 encloses the perimeter of the product and gives it a finished look. Preferably, the frame 18 is made of a material having a U-shaped cross section, with the sheet 10 and laminate 14 and any other layers, such as a backing sheet (not shown) fitting snugly into the U-shaped opening 20. The frame 18 may be secured to itself or to some other part of the product in order to hold it in place. This particular frame 18 is made of a rigid material, but it may instead be made of a flexible material that simply flexes to wrap around the perimeter of the board.

Figure 10:
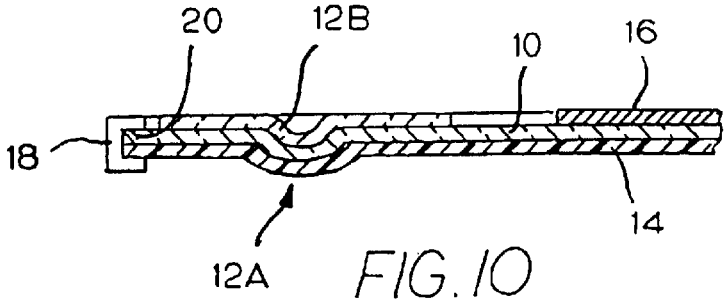
FIG. 10 is a schematic section view taken along the line 10—10 of FIG. 9.

FIG. 10 is a section view showing the frame 18, with its U-shaped recess 20 receiving the flat edges of the layers 10 and 14. It also shows the sheet 10, the coating layer 14, the reinforcement 12B, and the metal-containing sheet 16.

Figure 11:
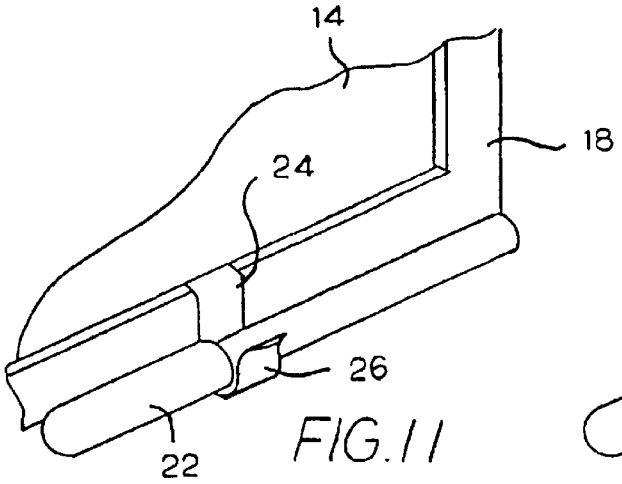
FIG. 11 is a schematic perspective view of a portion of the product of FIG. 9 with a dry erase marker attached.

It is desirable to provide a means for holding a dry erase marker 22 on the product so the user does not have to go searching for the special type of marker that is used on the dry erase board and so the special dry erase marker is not confused with other types of markers that are not readily erasable. FIGS. 11–15 show various types of mechanisms for retaining a dry erase marker 22 on the dry erase board. FIG. 11 shows a clip 24, which mounts over the edge of the frame 18 and which includes an elastic U-shaped portion 26, into which the marker 22 fits. The diameter of the marker 22 is slightly larger than the "at rest" width of the U-shaped portion 26, so the clip 24 has to deform slightly in order to receive the marker 22, and the legs of the clip 24 press against the sides of the marker 22, holding it in position on the board. Instead of clipping into the U-shaped recess of the frame 18, a clip (not shown) could instead clip over another part of the product, such as over the top of the frame 18.

Figure 12:
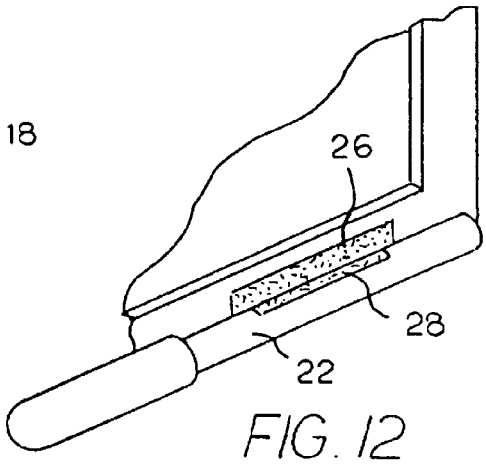
FIG. 12 is the same view as FIG. 11, but showing a different mechanism for retaining the dry erase marker.

FIG. 12 shows another alternative mechanism for retaining the dry erase marker 22 on the product. In this case, mating strips 26, 28 of hook-and-loop fastener are used, with one strip 26 being adhered to the product and the other strip 28 being adhered to the marker 22.

Figure 13:
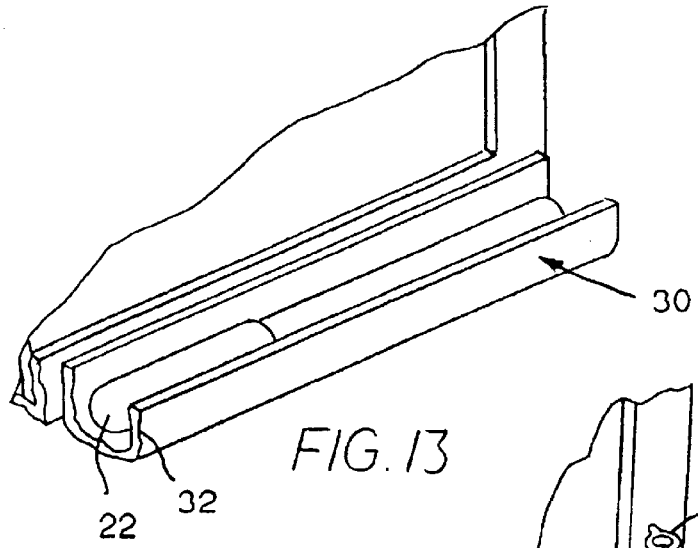
FIG. 13 is the same view as FIG. 12, but showing a different mechanism for retaining the dry erase marker.

FIG. 13 shows another alternative mechanism, in which a tray 30 is secured to the product. The tray 30 includes a front lip 32, which prevents the marker 22 from falling off the front.

Figure 14:
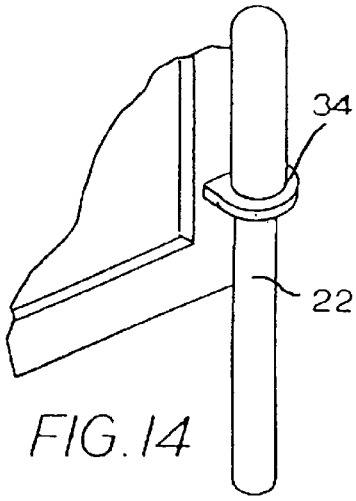
FIG. 14 is the same view as FIG. 13, but showing a different mechanism for retaining the dry erase marker.

FIG. 14 shows a portion of the product having a hole or opening 34 into which the marker 22 is received.

Figure 15:
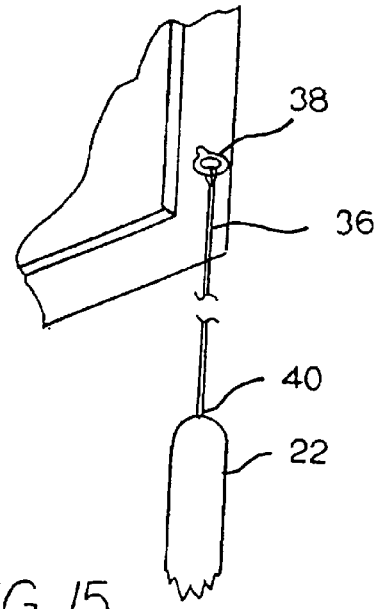
FIG. 15 is the same view as FIG. 14 but showing a different mechanism for retaining the dry erase marker.

FIG. 15 shows a string or chain 36 being secured at one end 38 to the dry erase board and at the other end 40 to the marker 22.

The foregoing description is intended to describe examples of products made in accordance with the present invention, but it will be obvious to those skilled in the art that many modifications may be made to the examples described above without departing from the scope of the present invention. For example, while the materials that have been described herein are very suitable for practicing this invention, it is understood that other currently known materials or subsequently developed materials could also fall within the scope of the claims.

What is claimed is:

1. A dry erase board, comprising:

a first sheet of material having a front surface;

an image carried on said first sheet;

a coating on said front surface, said coating providing a surface that is compatible with dry erase markers, and said image being visible through said coating;

wherein said first sheet and coating have a surface contour of varying heights in registration with the image in order to form a relief image.

2. A dry erase board as recited in claim 1, and further comprising a reinforcement behind the relief image of FIG. 1.

3. A dry erase board as recited in claim 1, wherein said first sheet of material has a perimeter, and further comprising a frame enclosing the perimeter of said first sheet.

4. A dry erase board as recited in claim 1 and further comprising means for retaining a dry erase marker on said first sheet of material.

5. A dry erase board as recited in claim 1, wherein said first sheet of material has at least ⅛ square feet of surface area on its front surface.

6. A dry erase board as recited in claim 5, wherein at least three-fourths of the front surface of said first sheet of material is flat.

7. A dry erase board as recited in claim 6, and further comprising means for retaining a dry erase marker on said board.

8. A dry erase board, comprising:

a first sheet of material having a perimeter and having a front surface area of at least one-eighth of a square foot;

a printed color image on said first sheet;

a coating over said front surface that is compatible with dry erase markers and through which said image is visible;

said first sheet of material and said coating having a contour of varying heights registered with said printed color image to provide a relief image, with at least half of said front surface being flat;

a frame around the perimeter of said first sheet of material;

a reinforcement behind said relief image; and means for securing a dry erase marker to said first sheet of material.

9. A dry erase board as recited in claim 8, and further comprising a metal-containing sheet lying behind said first sheet of material so that a magnet will be attracted to said board.

10. A dry erase board as recited in claim 1, wherein said first sheet is made of a thermoplastic material.

11. A dry erase board as recited in claim 10, wherein said first sheet is between 0.07 gauge and 0.30 gauge thick.

12. A dry erase board as recited in claim 10, wherein said first sheet is made of styrene and the coating is made of vinyl.

13. A dry erase board as recited in claim 2, wherein said reinforcement is molded to the same surface contour as said image.

14. A dry erase board as recited in claim 13, wherein said first sheet and said reinforcement are made of thermoplastic material.

15. A method for making a dry erase board, comprising the steps of:

passing a first sheet of thermoplastic material through a printer;

printing an image on the thermoplastic material;

coating the front face of said first sheet with a coating that is compatible with dry erase markers; and thermoforming a portion of said coated first sheet to form raised contours in registration with the image, leaving a substantial portion of said coated first sheet flat.

16. A method for making a dry erase board as recited in claim 15, and further comprising the step of reinforcing the contoured portion of said first sheet.

17. A method for making a dry erase board as recited in claim 16, wherein said step of reinforcing includes inserting a second formed sheet having the same contours as said first sheet.

18. A method for making a dry erase board as recited in claim 15, and further comprising the step of adding a metal-containing sheet behind said first sheet.

19. A method for making a dry erase board as recited in claim 15, and further comprising the step of providing mounting means for mounting a dry erase marker on said board.

* * * * *